United States Patent [19]

Bonney

[11] Patent Number: 4,477,192

[45] Date of Patent: Oct. 16, 1984

[54] MAGNETIC STIRRING APPARATUS AND METHOD

[75] Inventor: Warren J. Bonney, Yardley, Pa.

[73] Assignee: Warner-Lambert Company, Morris Plains, N.J.

[21] Appl. No.: 392,401

[22] Filed: Jun. 25, 1982

[51] Int. Cl.[3] ..... B01F 13/08

[52] U.S. Cl. ..... 366/274; 356/39

[58] Field of Search ..... 310/156; 366/273, 274; 356/39, 246; 210/222

[56] References Cited

U.S. PATENT DOCUMENTS

| | | | |
|---|---|---|---|
| 3,384,353 | 5/1968 | Worth | 366/274 |
| 3,650,698 | 3/1972 | Adler | 356/39 |
| 3,754,866 | 8/1973 | Ritchie et al. | 356/39 |
| 3,969,079 | 7/1976 | Catarious et al. | 356/246 |
| 4,143,289 | 3/1979 | Williams | 310/156 |

FOREIGN PATENT DOCUMENTS

| | | | |
|---|---|---|---|
| 2107599 | 9/1971 | Fed. Rep. of Germany | 366/274 |

*Primary Examiner*—Robert W. Jenkins
*Assistant Examiner*—Arthur D. Dahlberg
*Attorney, Agent, or Firm*—Gary M. Nath

[57] ABSTRACT

The contents of a container are stirred by continuously and successively subjecting a magnetic stirring element provided in the container to a plurality of moving magnetic fields.

18 Claims, 6 Drawing Figures

MAGNETIC STIRRING APPARATUS AND METHOD

FIELD OF THE INVENTION

The present invention relates to methods and apparatus for stirring the contents of a container, and more particularly, to such methods and apparatus which utilize a magnetically driven stirrer.

BACKGROUND OF THE INVENTION

Magnetic stirrers have been known for many years. Typically, in these known magnetic stirrers, a magnetic stirring bar is placed in a container of liquid. By rotating a permanent magnet below the container, a rotating magnetic field is produced which, in turn, causes the magnetic stirring bar to rotate within the container, thereby stirring the contents thereof. These magnetic stirrers are especially useful to maintain the suspension of a reagent, such as a protein suspension, which is to undergo coagulation testing (see, for instance, U.S. Pat. Nos. 3,754,866 and 3,650,698).

Generally, the effectiveness of any mixing technique is directly proportional to the amount of turbulence created thereby. In the known magnetic stirrers described above, the turbulence in the liquid to be mixed is created primarily by a simple rotational movement of the stirring bar. Because the rotation of the stirring bar is relatively constant and uniform, a vortex is formed in the liquid being mixed. The creation of a vortex is disadvantageous because it limits the amount of turbulence that can be created in the liquid and tends to pull heavier particles to the bottom of the container.

SUMMARY OF THE INVENTION

The problems and disadvantages of the prior art devices described above are overcome by the present invention which, like the prior art devices, utilizes a magnetic stirring element positioned in a container whose contents, usually a liquid, are to be stirred. In direct contrast to the prior art devices, the magnetic stirring element to the present invention is successively subjected to a plurality of moving magnetic fields which cause the magnetic stirring element to move erratically in the container. Because of the erratic movement of the magnetic stirring element, the contents of the container are kneaded and stirred, thereby increasing the turbulence of the contents of the container to effect better mixing. The kneading action of the stirring element also inhibits the formation of a vortex in the liquid or other material which is being mixed, thereby improving the homogeneity of the liquid.

In one embodiment of the present invention, the magnetic fields are rotated past the magnetic stirring element in rapid succession, e.g., at a rate in a range of from about 50 rpm to about 150 rpm. Such rotating magnetic fields can be produced by, for instance, mounting a plurality of permanent magnets on a rotor which is rotatable about an axis of rotation. More particularly, the rotor includes a first pair of magnets arranged in end-to-end fashion with like poles positioned adjacent to each other and a second pair of magnets arranged a predetermined distance from the first pair of magnets and in end-to-end fashion with like poles positioned adjacent to each other.

In order to enhance the erratic movement of the magnetic stirring element, the container can be removably received in a receptable which is positioned offcenter relative to the axis of rotation of the rotor. By positioning a plurality of containers offcenter relative to the rotor, the present invention may be used to simultaneously mix the contents of all of the containers using a single rotor.

BRIEF DESCRIPTION OF THE DRAWINGS

For a more complete description of the present invention, reference is made to the following detailed description of an exemplary embodiment considered in conjunction with the accompanying drawings, in which.

DESCRIPTION OF AN EXEMPLARY EMBODIMENT

Figure 1:
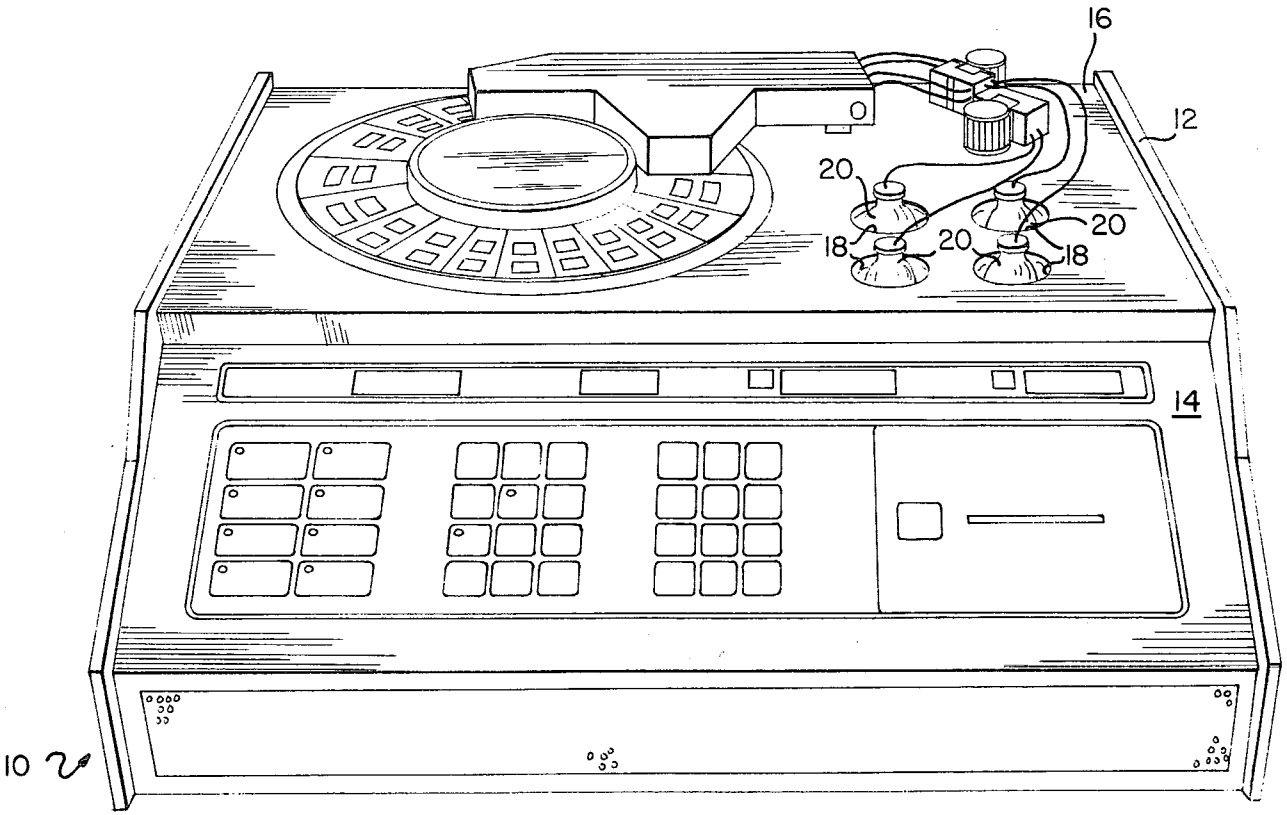
FIG. 1 is a perspective view of a photo-optical clot detection device employing a reagent stirring and cooling subassembly which is constructed in accordance with the present invention.
Figure 2:
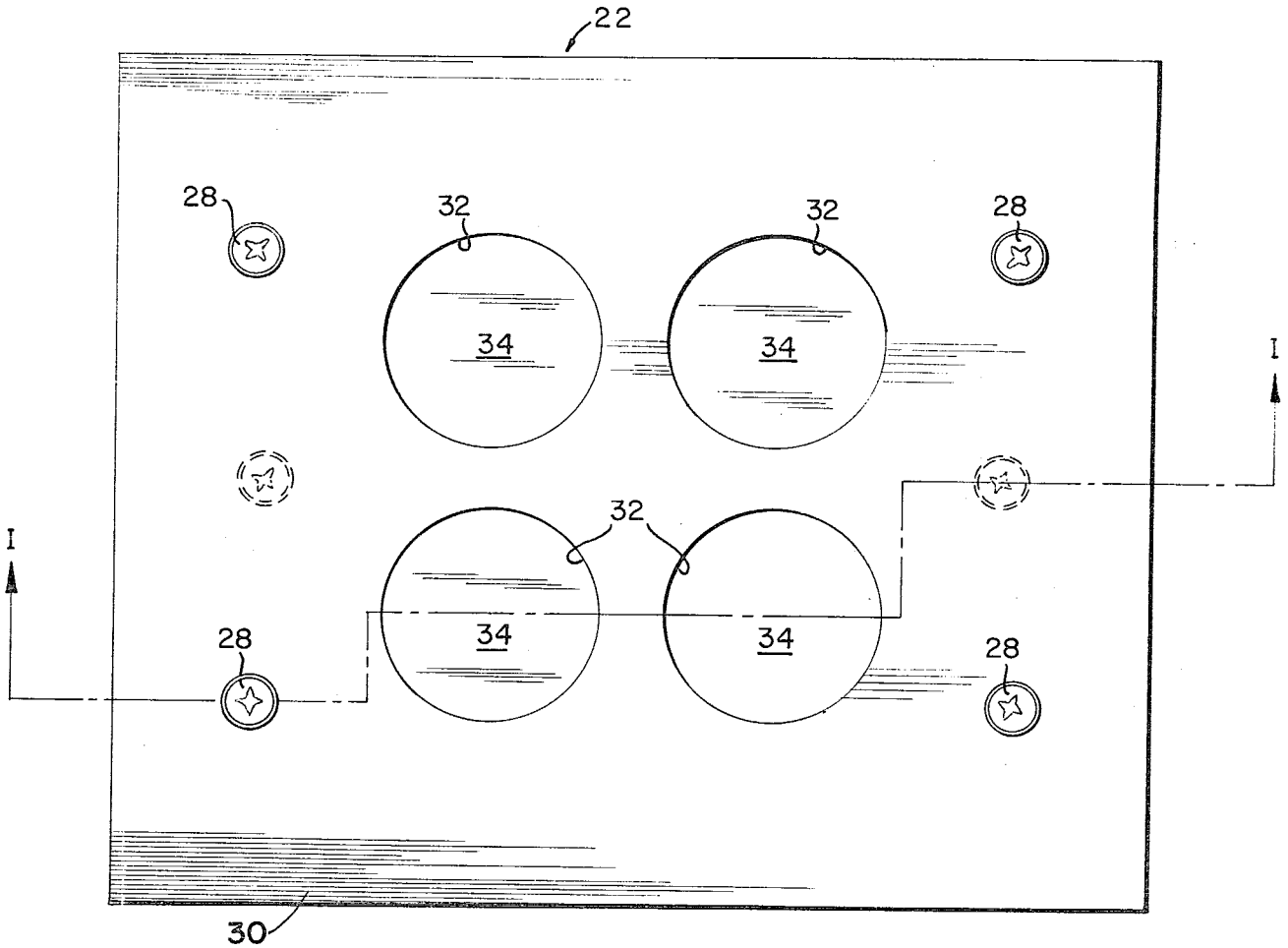
FIG. 2 is a plan view of the reagent stirring and cooling subassembly employed by the photo-optical clot detection device shown in FIG. 1.
Figure 3:
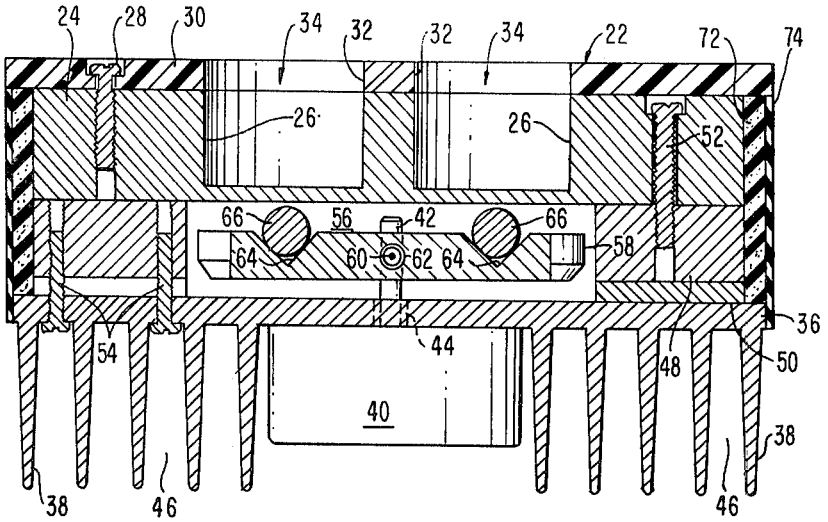
FIG. 3 is a cross-sectional view, taken along section line I—I of FIG. 2 and looking in the direction of the arrows, of the reagent stirring and cooling subassembly illustrated in FIG. 2.

Referring to FIG. 1, there is shown a photo-optical clot detection device 10 which is the successor of the apparatus described and illustrated in Catarious, et al. U.S. Pat. No. 3,969,079. The photo-optical clot detection device 10 operates in basically the same manner as the apparatus of the Catarious, et al. patent, the disclosure of which is incorporated herein by reference.

Briefly, the photo-optical clot detection device 10 includes a housing 12 having a front panel 14 and a top panel 16, which is provided with openings 18 therein. Each of the openings 18 provides access to a corresponding stirring and cooling well of a stirring and cooling subassembly (see FIGS. 2–5) mounted within the housing 12 directly below the top panel 16 thereof. The openings 18 are wide enough so that vials 20 containing a reagent, such as a protein suspension, which is to undergo the coagulation tests described in the Catarious et al. patent, can be inserted into the stirring and cooling wells of the stirring and cooling subassembly (see FIGS. 2–5). Each of the vials 20 also is provided with a magnetic stirring bar (see FIG. 6), so that the contents of the vials 20 may be mixed in a manner to be described hereinafter.

With particular reference now to FIGS. 2–5, there is shown a reagent stirring and cooling subassembly 22 which is adapted for use in the photo-optical clot detection device 10 of FIG. 1. More particularly, the stirring and cooling subassembly 22 includes a cooling block 24 made from a material, such as aluminum or stainless steel, having a good thermal conductivity. The cooling block 24 is provided with four blind holes 26. Screws 28 attach an insulator plate 32 to the cooling block 24. The insulator plate 30 is made from a thermal insulating material, such as a high density plastic, so as to thermally insulate the cooling block 24 from the top panel 16 of the photo-optical clot detection device 10. The insulator plate 30 has four holes 32, each of which is in alignment with a corresponding one of the blind holes 26 formed in the cooling block 24. The holes 32 cooperate with the holes 26 to form four stirring and cooling wells 34, each of which is adapted to removably receive one of the vials 20 containing the reagent to undergo coagulation testing by the photo-optical clot detection device 10 of FIG. 1.

A heat sink 36 is positioned below the cooling block 24. The heat sink 36, which is made from a good thermal conducting material, such as aluminum or stainless steel has a plurality of downwardly extending fins 38 designed to increase the heat conducting capability of the heat sink 36 by increasing its surface area. The fins 38 surround an electric motor 40 which depends from the heat sink 36. The electric motor 40 has a rotatable shaft 42 which extends upwardly through a hole 44 in the heat sink 36. Channels 46 are formed between the fins 38 so that air can be blown through the heat sink 36 in order to transfer by convection the heat conducted from the cooling block 24 to the heat sink 36.

A pair of risers 48 and a pair of thermo-electric cooling modules 50 are interposed between the cooling block 24 ad the heat sink 36. More particularly, one of the risers 48 and one of the cooling modules 50 are arranged on one side of the stirring and cooling subassembly 22, while the other of the risers 48 and the other of the cooling modules 50 are arranged on an opposite side of the stirring and cooling subassembly 22. Screws attach the risers 48 to the cooling block 24, while screws 54 attach the risers 48 to the heat sink 36. Each of the risers 48 is made from a good thermal conducting material, such as aluminum or stainless steel. The cooling modules 50 can be of any suitable type, such as Model No. 801-2003-01-00-00 manufactured by Cambion. By reversing the current flow in the cooling modules 50, they can be employed as heaters to heat, rather than to cool, the stirring and cooling wells 34.

The risers 48 and the cooling modules 50 cooperate to form a chamber 56 between the cooling block 24 and the heat sink 36. A rotor 58 is positioned in the chamber 56 for rotation along with the shaft 42 of the electric motor 40. The rotor 58 is removably attached to the shaft 42 of the electric motor 40 by a set screw 60 threadedly received in a radially extending bore 62 provided in the rotor 58. The rotor 58 is also provided with a pair of V-shaped grooves 64 arranged along parallel chords of the rotor 58. Each of the grooves 64 receives a pair of permanent magnets 66.

Figure 5:
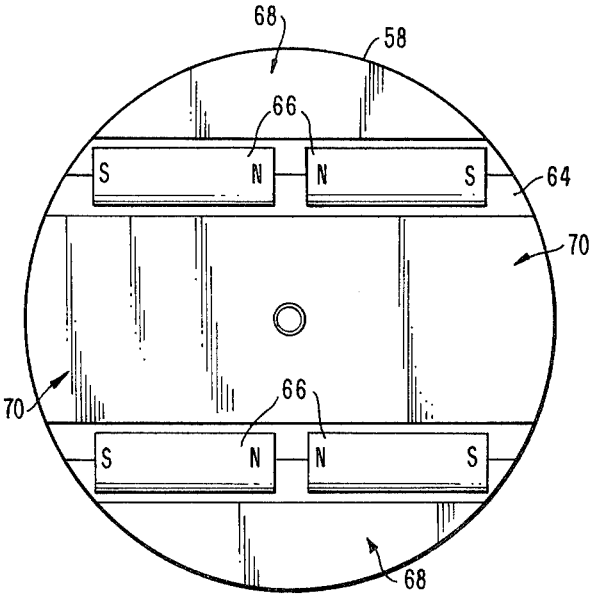
FIG. 5 is a plan view of a rotor utilized by the reagent stirring and cooling subassembly of FIGS. 2–4.

With particular reference to FIG. 5, the magnets of each of the pairs of permanent magnets 66 are arranged in end-to-end fashion with like poles being positioned adjacent to each other. By this magnet arrangement, four magnetic fields are produced: a pair of strong repelling fields 68 and a pair of weak repelling fields 70. Other magnet configurations are possible. For instance, four permanent magnets can be arranged in a rectangular or square pattern such that each pole of each magnet is arranged adjacent to a like pole of one of the other magnets. Also, three pairs of permanent magnets can be arranged in a triangular pattern such that each pair of magnets forms one leg of the triangular pattern and each pole of each magnet is arranged adjacent to a like pole of one of the other magnets.

Foam sheets 72 and rubber strips 74 thermally insulate the cooling block 24, the risers 48 and the cooling modules 50 from the rest of the photo-optical clot detection device 10. The foam sheets 72 and the rubber strips 74 also inhibit the entry of ambient air into the stirring and cooling subassembly 22 in order to inhibit the condensation of moisture thereon.

Figure 6:
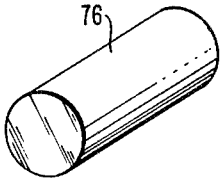
FIG. 6 is a perspective view of a stirring bar employed in combination with the reagent stirring and cooling subassembly of FIGS. 2–4.
Figure 4:
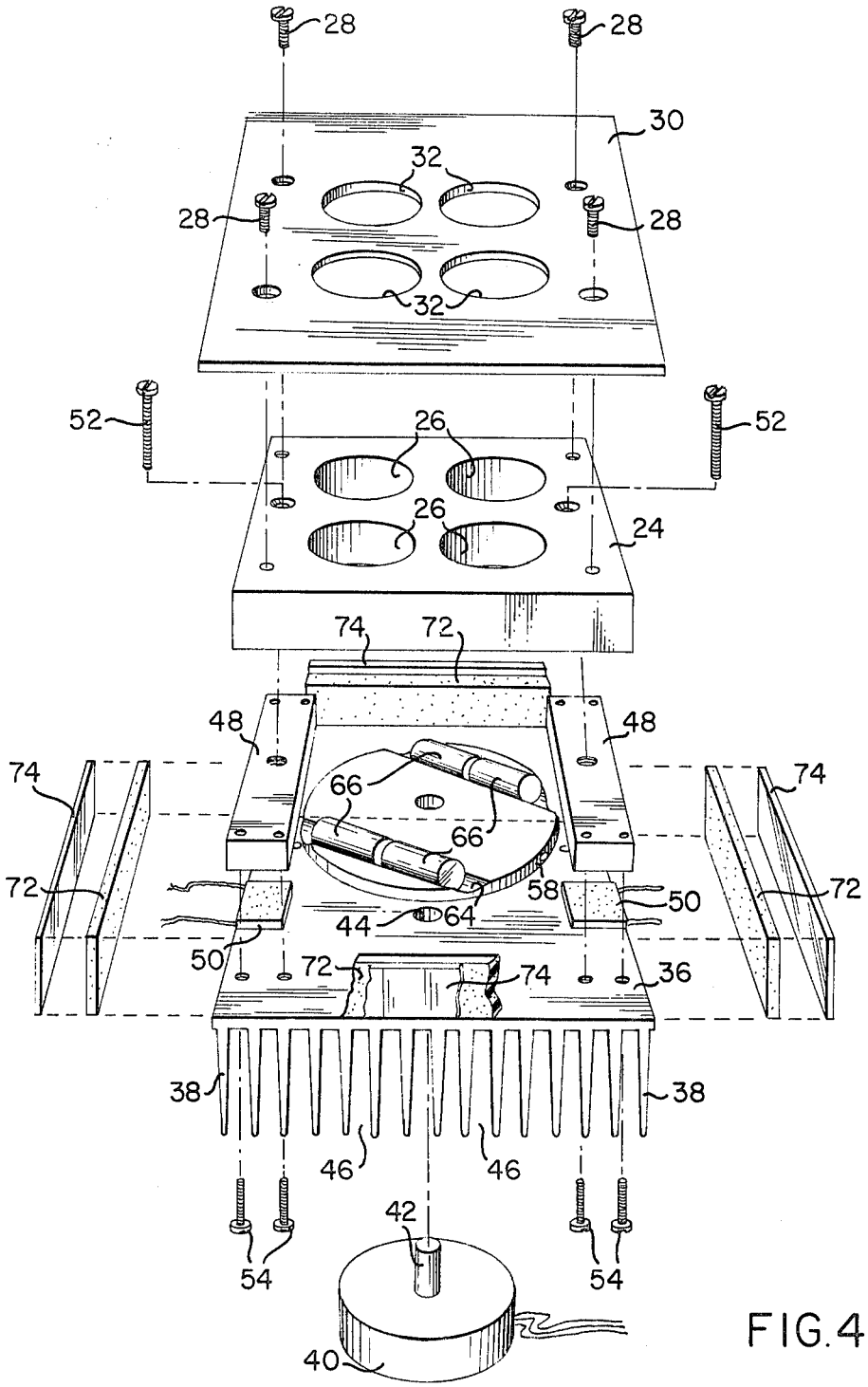
FIG. 4 is an exploded view of the reagent stirring and cooling subassembly of FIGS. 2–3.

Referring now to FIG. 6, there is shown a stirring bar 76 adapted for insertion into one of the vials 20. The stirring bar 76, which has a typical length of $\frac{3}{8}$ of an inch and a typical diameter of 1/16 of an inch, is preferably made from a ferritic alloy. The stirring bar 76 may be coated with Teflon or some other suitable material to ensure inertness.

In order to stir the contents of the vials 20, the rotor 58 of the stirring and cooling subassembly 22 is rotated by the electric motor 40 at a rate in a range of from about 50 rpm to about 150 rpm depending upon the viscosity of the liquid ad the size of the stirring bar 76. Whereby the strong and the weak magnetic fields 68, 70, respectively, are successively rotated past each of the vials 20 ad, thus, each of magnetic stirring bars 76 contained therein. As a result of being alternately subjected to the strong magnetic fields 68 and the weak magnetic fields 70, the magnetic stirring bars 76 move erratically in the vials 20 to thereby knead as well as stir the reagents contained therein. The kneading and stirring action of the stirring bars 76 increases the turbulence of the reagents contained in the vials 20 to effect better mixing thereof. Thus, in accordance with the present invention, the reagents contained in all four of the vials 20 can be thoroughly mixed simultaneously.

It will be understood that the embodiment described herein is merely exemplary ad that a person skilled in the art may make many variations and modifications without departing from the spirit and scope of the invention. All such modifications and variations are intended to be included within the scope of the invention as defined in the appended claims.

I claim:

1. Magnetic stirring apparatus for stirring the contents of a container by magnetically moving a stirrer positioned in the container, comprising subjecting means for continuously and successively subjecting the stirrer to a plurality of moving magnetic fields, said magnetic fields include at least one pair of relatively strong repelling fields and at least one pair of relatively weak repelling fields, whereby the stirrer moves erratically in the container to knead as well as stir the contents thereof.

2. Magnetic stirring apparatus according to claim 1, wherein said magnetic fields are rotated past the stirrer in rapid succession.

3. Magnetic stirring apparatus according to claim 2, wherein said subjecting means includes at least four magnets arranged such that each pole of each magnet is positioned adjacent to a like pole of one of the other magnets, whereby a plurality of repelling magnetic fields is produced.

4. Magnetic stirring apparatus according to claim 2, wherein said subjecting means includes a rotor rotatable about an axis of rotation, a first pair of magnets arranged in end-to-end fashion on said rotor with like poles positioned adjacent to each other and a second pair of magnets arranged in end-to-end fashion on said rotor with like poles positioned adjacent to each other, said second pair of magnets being spaced from said first pair of magnets.

5. Magnetic stirring apparatus according to claim 4, wherein said first pair of magnets is on one side of said rotor and said second pair of magnets is on an opposite side of said rotor.

6. Magnetic stirring apparatus according to claim 5, wherein said rotor has a circular shape and said first pair of magnets is arranged along a first chord of said rotor and said second pair of magnets is arranged along a second chord of said rotor.

7. Magnetic stirring apparatus according to claim 6, wherein said first and second chords are parallel to each other.

8. Magnetic stirring apparatus according to claim 4, wherein said like poles of said first pair of magnets have the same polarity as said like poles of said second pair of magnets.

9. Magnetic stirring apparatus according to claim 4, further comprising positioning means for positioning the container offcenter relative to said axis of rotation of said rotor.

10. Magnetic stirring apparatus according to claim 9, wherein said positioning means includes a plurality of receptacles, each receptable being positioned offcenter relative to said axis of rotation of said rotor and sized and shaped so as to receive the container, whereby the contents of a plurality of containers may be stirred simultaneously.

11. Magnetic stirring apparatus according to claim 10, wherein said receptacles are positioned above and in close proximity to said rotor.

12. Magnetic stirring apparatus according to claim 4, further comprising rotating means for rotating said rotor at a rate in a range of from about 50 rpm to about 150 rpm.

13. Magnetic stirring apparatus according to claim 1, wherein said apparatus is a subassembly of a photo-optical clot detection device.

14. A method of stirring the contents of a container by magnetically moving a stirrer positioned in the container, comprising the step of continuously and successively subjecting the stirrer to a plurality of moving magnetic fields, said magnetic fields include at least one pair of relatively strong repelling fields and at least one pair of relatively weak repelling fields, whereby the stirrer moves erratically in the container to knead as well a stir the contents thereof.

15. A method according to claim 14, wherein said magnetic fields are rotated past the stirrer in rapid succession by rotating them about a common axis of rotation.

16. A method according to claim 15, wherein the container is positioned offcenter relative to said axis of rotation of said magnetic fields.

17. A method according to claim 14, wherein said magnetic fields are rotated at a rate in a range of from about 50 rpm to about 150 rpm.

18. A method according to claim 14, wherein said magnetic fields include a plurality of repelling fields.

* * * * *